US006433754B1

(12) United States Patent
Boeringer

(10) Patent No.: US 6,433,754 B1
(45) Date of Patent: Aug. 13, 2002

(54) PHASED ARRAY INCLUDING A LOGARITHMIC SPIRAL LATTICE OF UNIFORMLY SPACED RADIATING AND RECEIVING ELEMENTS

(75) Inventor: Daniel Wilharm Boeringer, Silver Spring, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/862,483

(22) Filed: May 23, 2001

Related U.S. Application Data

(60) Provisional application No. 60/212,676, filed on Jun. 20, 2000.

(51) Int. Cl.[7] ..... H01Q 21/00; H01Q 1/36

(52) U.S. Cl. ..... 343/893; 343/895

(58) Field of Search ..... 343/893, 895, 343/DIG. 2, 844, 770, 792.5, 810, 853; H01Q 21/00, 1/36

(56) References Cited

U.S. PATENT DOCUMENTS

| | | | | | |
|---|---|---|---|---|---|
| 3,504,368 | A | * | 3/1970 | Ruben | 343/701 |
| 3,811,129 | A | * | 5/1974 | Holst | 343/844 |
| 4,754,286 | A | * | 6/1988 | Brunner et al. | 343/771 |
| 4,797,682 | A | * | 1/1989 | Klimczak | 343/844 |
| 5,838,284 | A | * | 11/1998 | Dougherty | 343/893 |
| 6,115,005 | A | * | 9/2000 | Goldstein et al. | 343/895 |
| 6,205,224 | B1 | * | 3/2001 | Underbrink | 381/92 |

* cited by examiner

*Primary Examiner*—Hoanganh Le
*Assistant Examiner*—Trinh Do Dinh

(57) ABSTRACT

A sparse phased array including a generally logarithmic spiral lattice of multiple radiating and receiving elements defining a logarithmic spiral of no translational periodicity which ameliorates grating lobes, even for wide element placement. The array has a substantially equal unit cell size per radiating element which in turn best matches the array to the medium and is capable of operating at relatively high power levels in one or more frequency bands. The unit cells include an area wherein each of said unit cells include an area of space around the respective antenna element within which all points therein are closer to said respective antenna elements than to any other antenna element of said plurality of antenna elements.

5 Claims, 4 Drawing Sheets

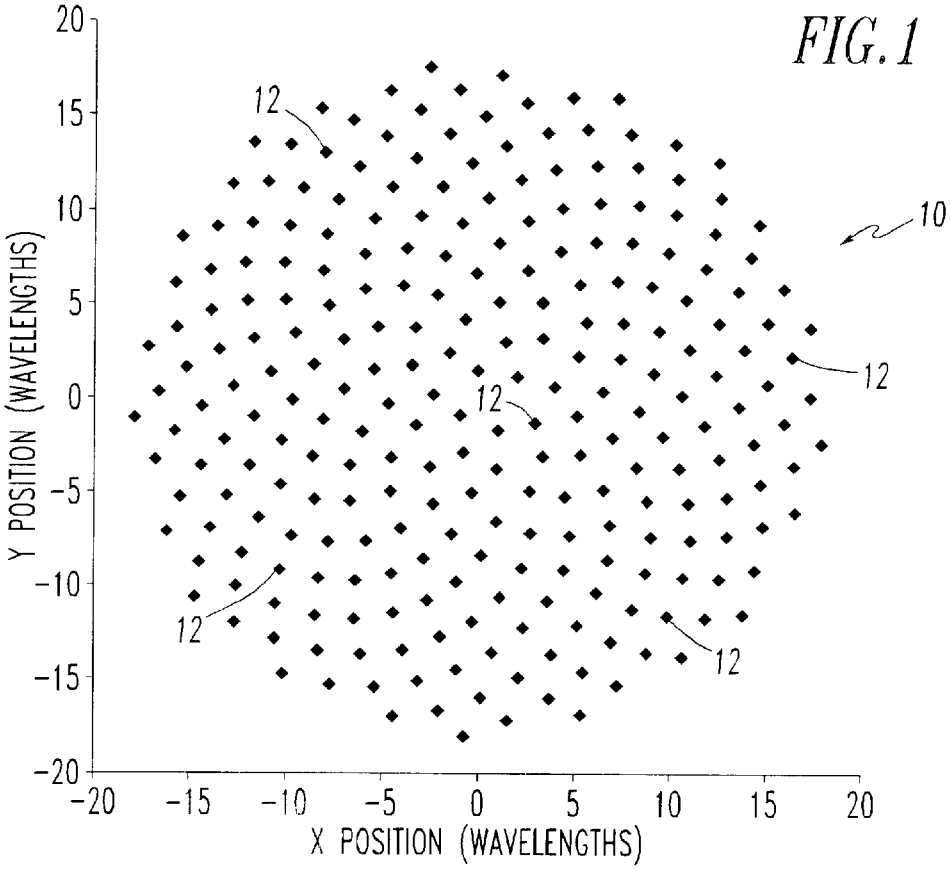
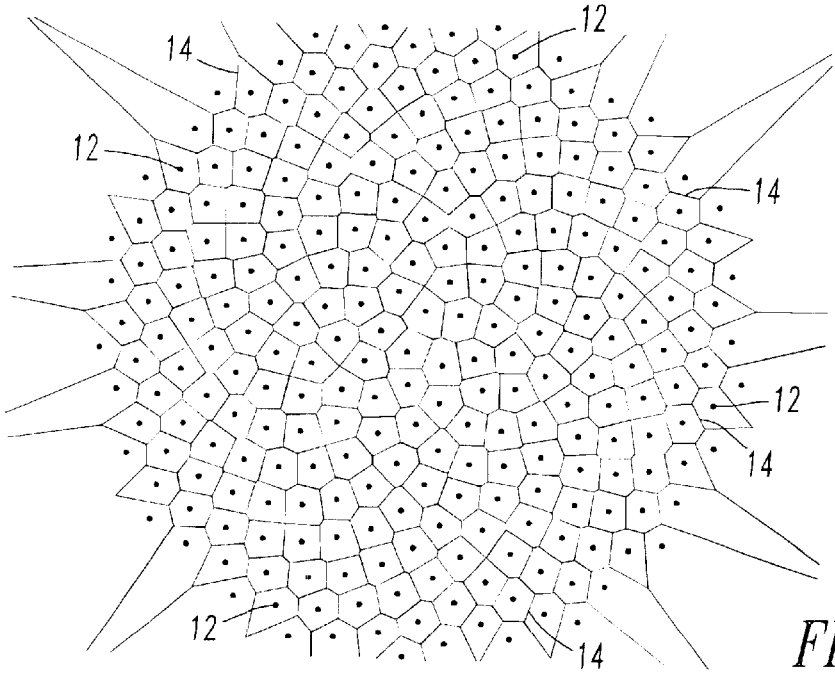
FIG. 2

Y POSITION (WAVELENGTHS)
X POSITION (WAVELENGTHS)
20
15
10
5
0
-5
-10
-15
-20
-20
-15
-10
-5
0
5
10
15
20
18
16

Y POSITION (WAVELENGTHS)
X POSITION (WAVELENGTHS)
20
15
10
5
0
-5
-10
-15
-20
-20
-15
-10
-5
0
5
10
15
20
18
12
10

PHASED ARRAY INCLUDING A LOGARITHMIC SPIRAL LATTICE OF UNIFORMLY SPACED RADIATING AND RECEIVING ELEMENTS

This application is a Non-Provisional application claiming priority based on Provisional Application Ser. No. 60/212,676 filed on Jun. 20, 2000 and which is meant to be incorporated herein by reference.

BACKGROUND OF THE INVENTION

1. Field of the Invention

This invention relates generally to arrays of radiating and receiving elements, and more particularly to phased arrays of radiating and receiving elements.

2. Description of Related Art

Phased arrays of radiating and receiving elements such as, but not limited to antenna elements, are generally constructed with periodic rectangular or triangular grids. However, periodic grids have the disadvantage that when the element spacing much exceeds one-half wavelength ($\lambda/2$) of the operating frequency, large grating lobes appear, especially when the antenna is electronically scanned. Accordingly, there is a constant effort in the field of antenna design to design phased array antennas which substantially reduce or eliminate grating lobes.

SUMMARY

Accordingly, it is an object of the present invention to provide an improvement in antenna arrays.

It is another object of the present invention to provide an improvement in phased array antennas.

It is a further object of the present invention to provide an improvement in phased array antennas which ameliorates grating lobes.

It is still another object of the present invention to provide an improvement in phased array antennas which provides a sparse grid which reduces element density per unit area and thus reduces cost.

These and other objects are achieved by a sparse array antenna comprised of a packed logarithmic spiral lattice of radiating elements.

In one aspect of the invention, a phased array antenna is provided comprising a packed logarithmic spiral lattice arrangement of uniformly placed radiating elements, generally arranged according to the polar equations r and θ such that $$r = \frac{d}{\sqrt{\pi}}\sqrt{n}\text{, and } \theta = 2\pi\tau n,\ n = 1, \ldots, N$$

where n is the number of elements, d is the equivalent one-dimensional linear spacing in wavelengths between one antenna element to another, and τ is the golden ratio $$\tau = \frac{1+\sqrt{5}}{2} \approx 1.618.$$

Further scope of applicability of the present invention will become apparent from the detailed description provided hereinafter. However, it should be understood that the detailed description and specific example, while disclosing the preferred embodiment of the invention, is given by way of illustration only, since various changes and modifications within the spirit and scope of the invention will become apparent to those skilled in the art from this detailed description.

BRIEF DESCRIPTION OF THE DRAWINGS

The present invention will be more fully understood when the detailed description is considered in conjunction with the accompanying drawings which are provided for illustration only, and thus not meant to be limitative of the present invention, and wherein:

FIG. 1 is a top plan representation of a packed logarithmic spiral lattice of uniformly spaced radiating elements in accordance with the preferred embodiment of the invention;

FIG. 2 is a Voronoi diagram of Dirichlet domains showing unit cells or areas closest to each element for the arrangement shown in FIG. 1;

DESCRIPTION OF THE PREFERRED EMBODIMENT

Figure 3:
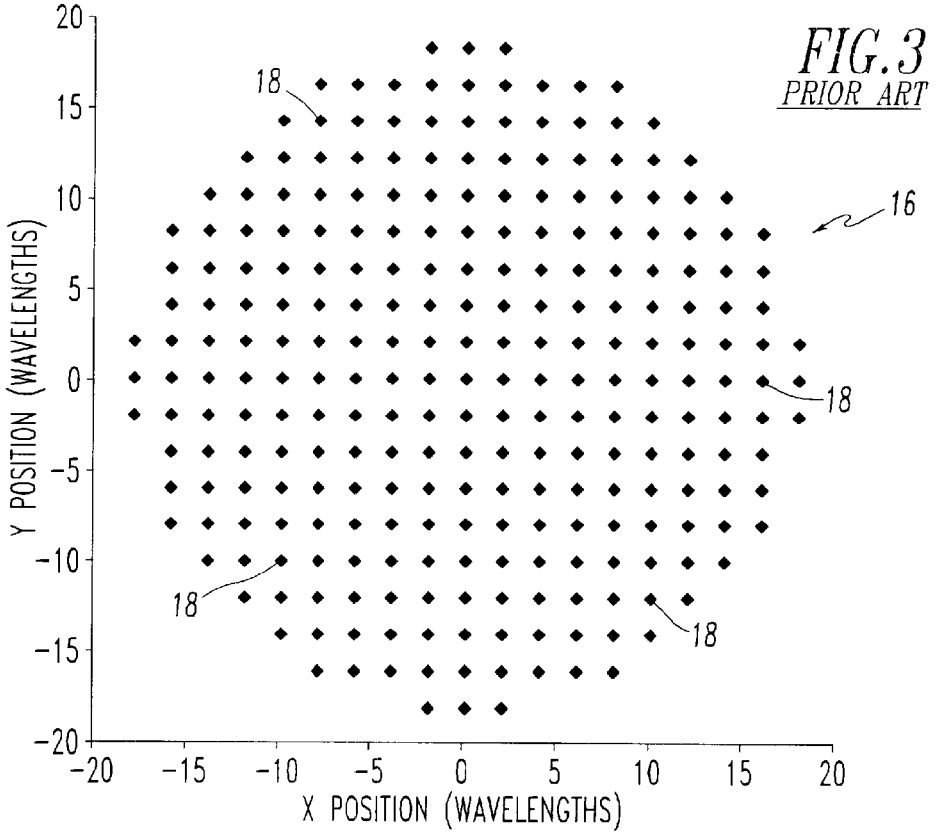
FIG. 3 PRIOR ART
FIG. 3 is a top planar diagram of a conventional rectangular periodic array of radiating elements.

Referring now to the drawings wherein like reference numerals refer to like parts, FIG. 1 is illustrative of a packed logarithmic spiral lattice 10 of two hundred and sixty one (261) radiating elements 12 defining what appears to be a plurality of mutually adjacent outwardly expanding spirals but actually are arranged along one continuous logarithmic spiral having no translational periodicity. Lack of translational periodicity such as present in a rectilinear array is readily evident. An arrangement such as shown in FIG. 1 has been found to provide grating lobe suppression. In a preferred embodiment of the invention as shown in FIG. 1, the elements 12 are uniformly arranged and having a density of one element per four square wavelengths, i.e., $2\lambda$. The logarithmic spiral arrangement of the radiating elements 12, moreover, is governed by the polar equations $$r = \frac{d}{\sqrt{\pi}}\sqrt{n}\text{, and } \theta = 2\pi\tau n,\ n = 1, \ldots, N,$$

where n is the number of elements, d is the equivalent one-dimensional linear spacing in wavelengths between one antenna element 12 to another, and τ is the golden ratio $$\tau = \frac{1+\sqrt{5}}{2} \approx 1.618.$$

The golden ratio is a fundamental ratio found over and over again in nature. Geometrically, it can be defined as the ratio obtained if a line is divided so that the length of the shorter segment is in the same proportion to that of the longer segment as the length of the longer segment is to the entire line. Mathematically, these ratios are such that the longer segment is 1.618054 times the length of the shorter segment.

The choice of these polar equations maintains a substantially uniform cell size per elements. This uniformity of unit cell sizes helps match the antenna to the medium. Similarly, this uniformity of cell sizes explains the ubiquity of this spiral grid arrangement found so often in nature. For example, when seeds taken such an arrangement in a sunflower head, each seed receives an equal share of sunlight. The unit cells are depicted in FIG. 2 which comprises a Voronoi diagram depicting the Dirichlet domains 14 for the antenna elements 12 and which define unit cells. A Dirichlet domain can be defined for the subject invention as the area of space around the antenna elements 12 within which all points are closer to the specific element than to any other antenna element 12. As shown, the unit cells 14 are all approximately equal in size. With minor position perturbations off the logarithmic spiral defined by the polar equations set forth above, the unit cells can be rendered exactly equal in size.

Referring now to FIG. 3, shown thereat is a rectangular grid array 16 of two hundred sixty one (261) elements 18 shown in FIG. 3, and which is illustrative of a conventional rectangular-periodic array of elements 12, spaced at one element per four square wavelengths.

Figure 4:
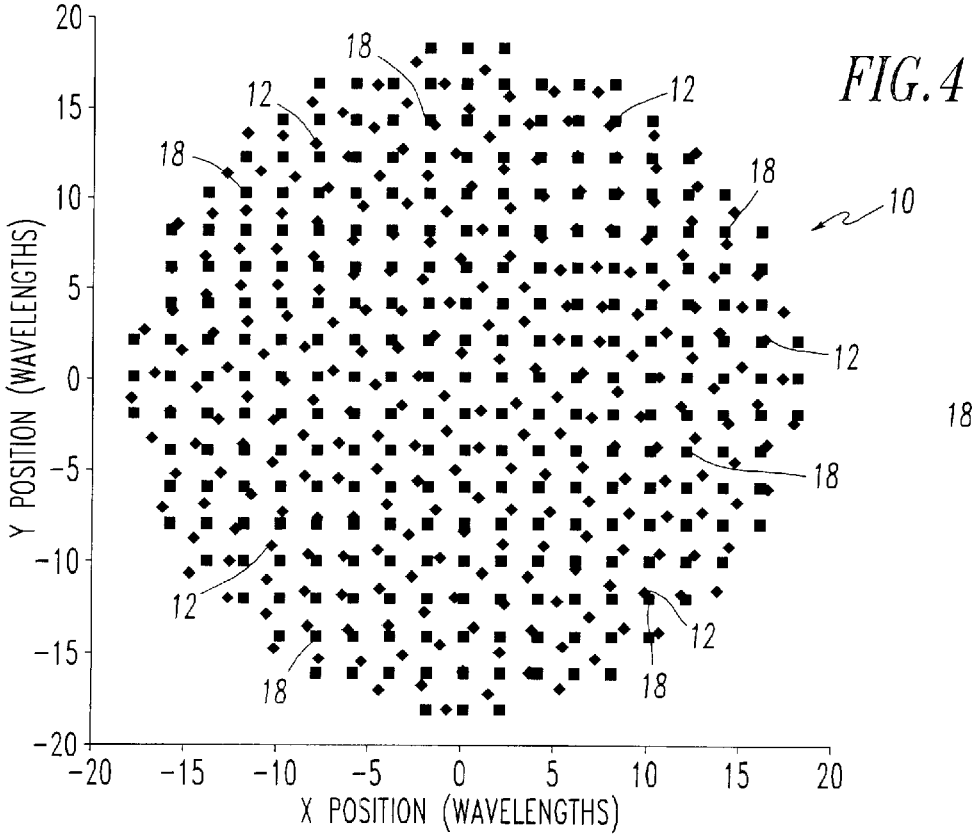
FIG. 4 is a top planar representation of the rectangular array shown in FIG. 3 overlaid on the spiral array shown in FIG. 1.

FIG. 4 shows the rectangular array 16 of FIG. 3 superimposed on the spiral array 10 of FIG. 1. It is to be noted that they both have the same number of antenna elements 12 and 18, i.e., 261 elements, the same element density, and cover the same area; however, the spiral array does not have periodic linear spacing which gives rise to grating lobes when the spacing exceeds a half wavelength.

Figure 5:
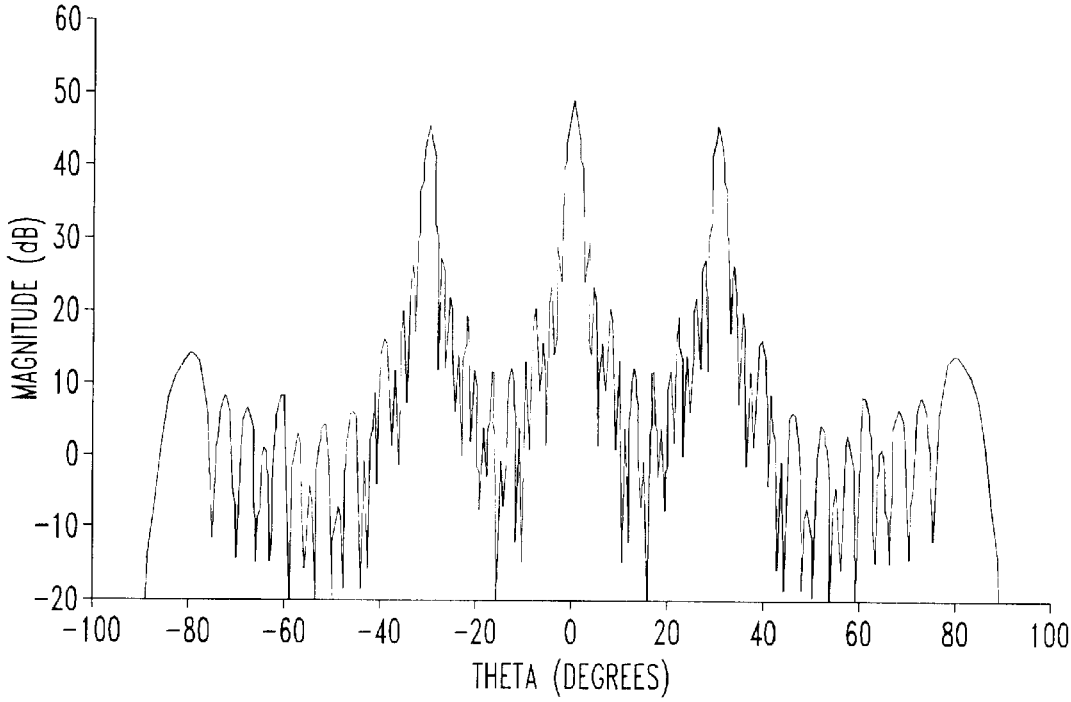
FIG. 5 is illustrative of the far field radiation pattern of the rectangular array of elements shown in FIG. 3.

FIG. 5 is illustrative of the far field pattern for the rectangular array 16 shown in FIG. 3. The pattern is shown including a main beam 20 and two relatively large grating lobes 22. The large grating lobes from this very sparse array are, moreover, only a few dB below the peak of the main beam 20.

Figure 6:
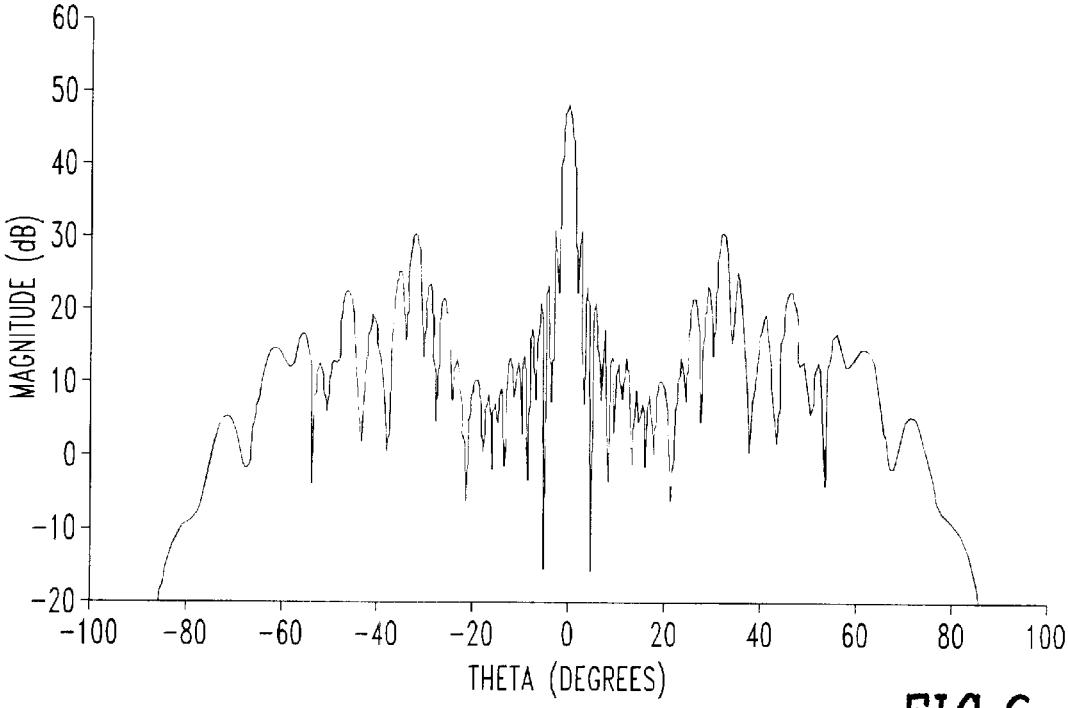
FIG. 6 is a far field radiation pattern of the spiral grid of radiation elements shown in FIG. 1.

FIG. 6, on the other hand, is illustrative of the far field pattern of the spiral array of FIG. 1 where, as in FIG. 5, reference numeral 20 represents the lobe of the main beam, while reference numeral 22 represents the grating lobes. In such a configuration, a 15 dB reduction in grating lobe peak values is achieved. This reduction in grating lobes results from the lack of translational periodicity in the spiral lattice. Note that the grating lobe energy is still present in the sidelobes, but rather than having grating lobes of high magnitude the grating lobe energy coalesces into grating rings of less magnitude.

Figure 7:
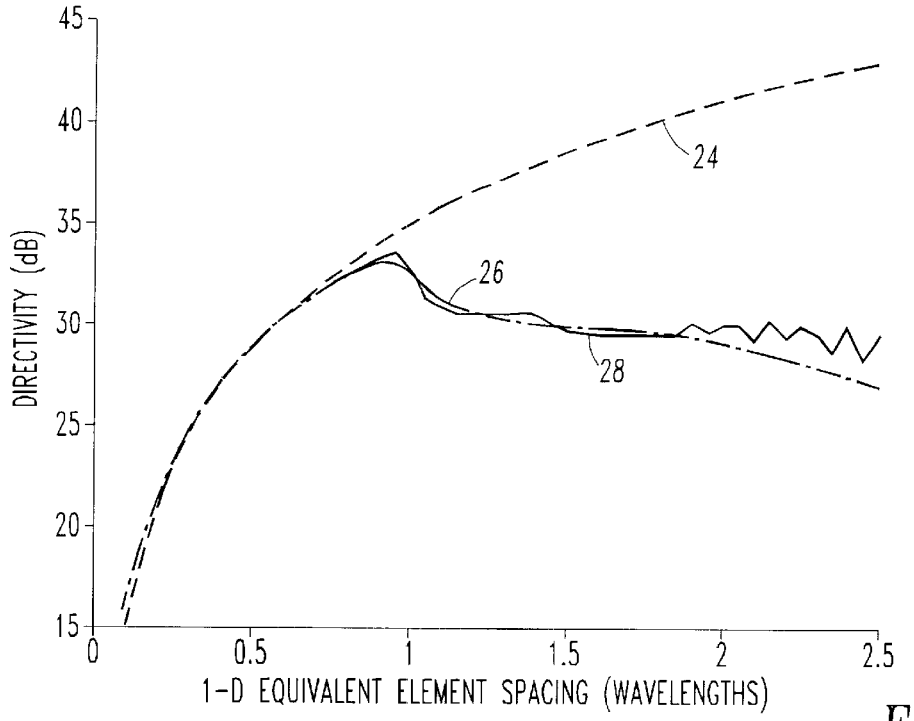
FIG. 7 is a set of graphs illustrative of the directivity of the spiral array shown in FIG. 1 compared to the rectangular array shown in FIG. 3 for no scan.
Figure 8:
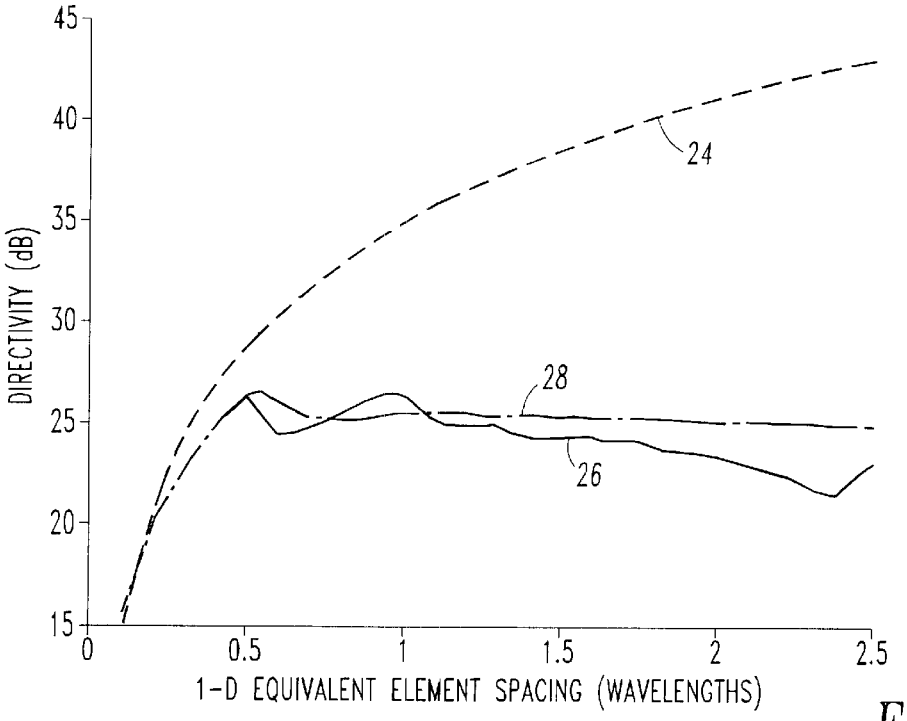
FIG. 8 is a set of graphs illustrating the directivity of the spiral array shown in FIG. 1 compared to the rectangular array shown in FIG. 3 for a 60° scan and a cos (θ) element factor.

Referring now to FIGS. 7 and 8, these curves depict directivity as a function of element spacing and where directivity is a measure of integrated sidelobe energy with respect to peak power, FIGS. 7 and 8 show that the spiral grid maintains directivity comparable to the rectangular array both at broadside and extreme scan. For example, FIG. 7 is a set of graphical illustrations depicting the directivity of spiral array compared to rectangular array, with no scan, where reference numeral 24 represents a plot of ideal directivity, based only on array size without grating lobe intrusion, and where the plot of reference numeral 26 represents rectangular grid (FIG. 3) directivity and the plot of reference numeral 28 represents spiral grid (FIG. 1) directivity. The directivity of the spiral array compares well with the rectangular array directivity over a wide range of element spacings.

FIG. 8 is a graph including the same plots 24, 26, 28 of directivity of spiral array compared to rectangular array, but with 60° scan and cos (θ) element factor. The directivity of the spiral array again compares well with the rectangular array directivity over a wide range of element spacings.

Thus an antenna according to the subject invention lacks translational periodicities which in turn ameliorates grating lobes even for wide element spacings, and maintains a substantially constant unit cell size per radiating element which in turn best matches the antenna to the medium. Such an antenna also maintains low peak sidelobes, without sacrificing directivity, at far higher frequencies than a conventional translational-periodic antenna of the same element density and can operate in more than one frequency band, for example, the X and Ku bands. Thus a spiral grid according to this invention having an X-band density satisfies the required specification for both X and Ku band frequencies.

When an antenna for a particular application, such as EW, requires a smaller element spacing than the module cases will physically permit, a "neck-down" assembly would be required to match the large module grid to the tight radiator grid. A spiral array in accordance with the subject invention can eliminate the need for such an assembly by allowing the radiator grid to grow and match the module grid and thus would reduce the cost and complexity of this type of antenna while maintaining low sidelobes.

It should be noted that while the foregoing detailed description is directed to phased array antennas of electromagnetic radiation, these principles are equally applicable to sonar phased arrays, where instead of producing and measuring electromagnetic waves with arrays of radiating elements, sound waves can be generated and measured with an array of vibrating transducers.

The foregoing detailed description merely illustrates the principles of the invention. It will thus be appreciated that those skilled in the art will be able to devise various arrangements which, although not explicitly described or shown herein, embody the principles of the invention and are thus within its spirit and scope.

What is claimed is:

1. A sparse phased array antenna, comprising:

a plurality of antenna elements arranged in a lattice of an outwardly expanding generally logarithmic spiral, wherein the antenna elements are arranged so as to have no translational periodicity for eliminating grating lobes while maintaining a uniform density so that unit cells of substantially the same size per radiating element are formed, wherein each of said unit cells include an area of space around the respective antenna element within which all points therein are closer to said respective antenna elements than to any other antenna element of said plurality of antenna elements; and, wherein the antenna elements are generally arranged according to the polar equations $$r = \frac{d}{\sqrt{\pi}}\sqrt{n}\text{, and } \theta = 2\pi\tau n,\ n = 1, \ldots, N,$$

where n is the number of elements, d is the equivalent one-dimensional linear spacing in wavelengths between one antenna element to another, and τ is the golden ratio $$\tau = \frac{1+\sqrt{5}}{2} \approx 1.618.$$

2. The phased array according to claim 1, wherein the elements include electromagnetic and sound energy radiating and receiving elements.

3. The phased array antenna according to claim 1 wherein the antenna elements have a one element per four square wavelength density.

4. A sparse phased array antenna comprising:

a packed logarithmic spiral lattice arrangement of uniformly spaced antenna elements, and being spaced according to the polar equations $$r = \frac{d}{\sqrt{\pi}}\sqrt{n}\text{, and } \theta = 2\pi\tau n,\ n = 1, \ldots, N,$$

where n is the number of elements, d is the equivalent one-dimensional linear spacing in wavelengths between one antenna element to another, and τ is the golden ratio of approximately 1.618.

5. A method of ameliorating grating lobes in a sparse phased array antenna including a plurality of antenna elements, comprising the steps of:

arranging the antenna elements in a grid of an outwardly expanding spiral so as to have no translational periodicity; and spacing the antenna elements so as to have a substantially uniform density and forming unit cells of substantially the same size for each of said antenna elements, wherein each of said unit cells include an area of space around the respective antenna element within which all points therein are closer to said respective antenna elements than to any other antenna element of said plurality of antenna elements; and, wherein the step of spacing comprises spacing the antenna elements in accordance with the polar equations $$r = \frac{d}{\sqrt{\pi}}\sqrt{n}\text{, and } \theta = 2\pi\tau n,\ n = 1, \ldots, N,$$

where n is the number of elements, d is the equivalent one-dimensional linear spacing in wavelengths between one antenna element to another, and τ is a constant equal to the golden ratio $$\tau = \frac{1+\sqrt{5}}{2} \approx 1.618.$$

* * * * *